US005314084A

United States Patent [19]

Folta et al.

[11] Patent Number: 5,314,084

[45] Date of Patent: May 24, 1994

[54] TWO PIECE ALL PLASTIC SEAL

[75] Inventors: Christopher M. Folta, Boyertown; John M. Anes, Glenmoore; Homer J. Brown, Oreland, all of Pa.

[73] Assignee: The West Company, Incorporated, Phoenixville, Pa.

[21] Appl. No.: 933,405

[22] Filed: Aug. 21, 1992

[51] Int. Cl.[5] ..... B65D 41/58

[52] U.S. Cl. ..... 215/249; 215/251; 215/258; 215/263; 215/274; 215/307; 215/321; 215/350

[58] Field of Search ..... 215/247, 248, 249, 251, 215/258, 263, 272, 274, 307, 317, 321, 350; 220/306, 254, 257

[56] References Cited

U.S. PATENT DOCUMENTS

| | | | |
|---|---|---|---|
| 3,888,377 | 6/1975 | Stadler | 215/249 |
| 4,251,003 | 2/1981 | Bodenmann | 215/254 |
| 4,429,803 | 2/1984 | Butterfield | 215/247 X |
| 4,534,482 | 8/1985 | Bouché | 215/272 |
| 5,085,332 | 2/1992 | Gettig et al. | 215/249 |
| 5,088,612 | 2/1992 | Storar et al. | 215/247 |
| 5,143,236 | 9/1992 | Gueret | 215/247 X |
| 5,165,560 | 11/1992 | Ennis, III et al. | 215/247 |

FOREIGN PATENT DOCUMENTS 8804665 8/1988 Fed. Rep. of Germany ..... 215/249

*Primary Examiner*—Allan N. Shoap
*Assistant Examiner*—Stephen Cronin
*Attorney, Agent, or Firm*—Eugene E. Renz, Jr.

[57] ABSTRACT

A closure device for use with a container having an open neck finish, including an inner cap having a skirt terminating in an open end which engages the outside diameter of the finish. The inner cap is sized to initially engage the finish. The skirt has circumferentially spaced slits extending, which may function as lyophilization ports, which permit the inner cap to expand upon an axial closing force and engage the bottom of the finish. A liner is positioned in the inner cap proximate the closed end and is compressed against the finish when the cap is moved to alignment with the bottom of the finish. An outer cap is locked on to the inner cap in pre-assembly which then encloses the inner cap after complete assembly to seal and compress the liner between the finish and the inside face of the inner cap. In a preferred embodiment, an inwardly facing ridge is located on the inside of the inner cap to engage the liner by a distance sufficient to permit the liner to seal to the finish over the maximum variation of dimensions for the liner and for the crown on the finish.

9 Claims, 6 Drawing Sheets

FIG. 4
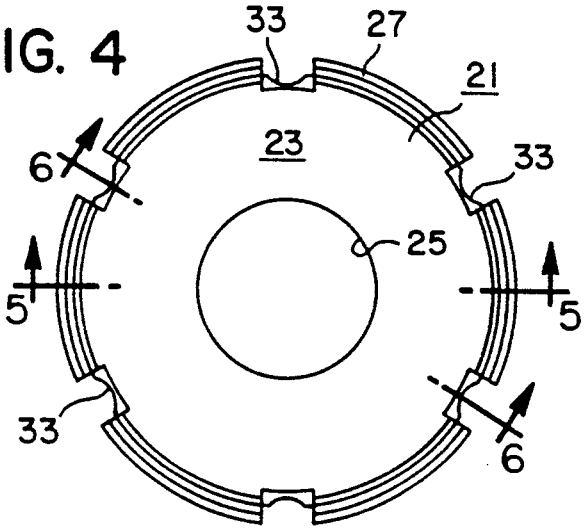
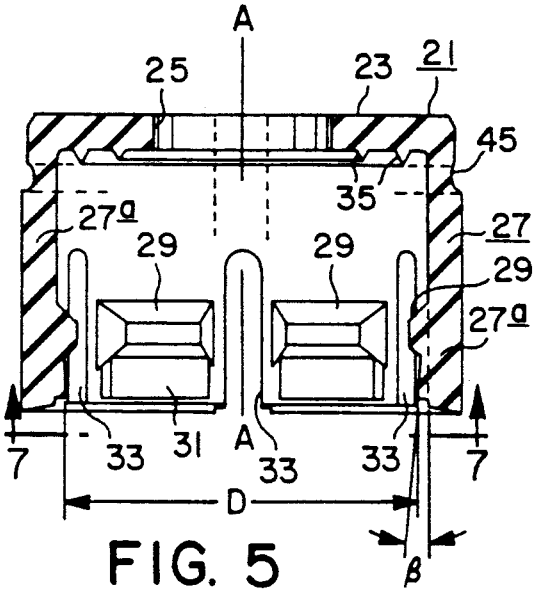
FIG. 5
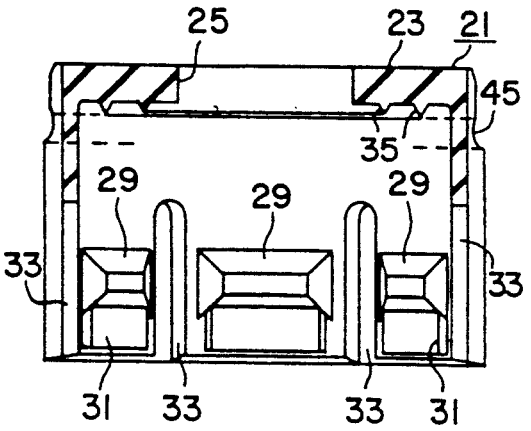
FIG. 6
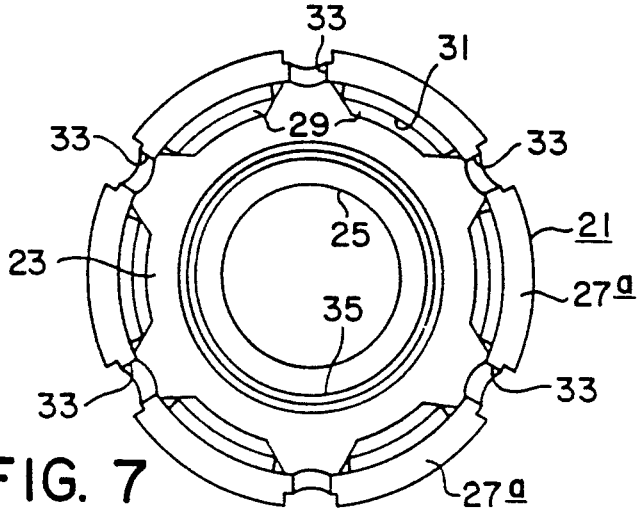
FIG. 7

TWO PIECE ALL PLASTIC SEAL

FIELD OF THE INVENTION

The present invention relates to a two piece all plastic seal, and more particularly to a seal device which is useful with a lyophilization container and which effectively seals the vial without the use of a metal cap seal.

BACKGROUND OF THE INVENTION

Medicaments have been packaged in containers such as glass vials with rubber stoppers for many years. As concern for package integrity and other packaging considerations have increased, various improvements have been adopted to provide more satisfactory container assemblies. One such development was the use of aluminum and other metal or metal alloys as a cap seal, where the aluminum seal is crimped or curved around the finish of the vial to hold the rubber stopper firmly in place. While this has been found to be ideal in some circumstances, aluminum seals are not the universal answer to all medical packaging concerns.

One particular packaging endeavor in the medical industry where aluminum seals have provided disadvantages as well as advantages is in lyophilization procedures where the stopper is partially inserted into the vial before a lyophilization procedure, followed by complete insertion of the stopper into the vial. Aluminum seals have prevented efficient lyophilization because it is difficult to apply a suitable crimp to the seal after the lyophilization step. In addition, silicone or some other lubricant is needed to insure adequate sealing. Finally, aluminum and other metals produce small particles when handled which are difficult to keep out of vials being filled, requiring inspection or other expensive product control steps. It would be of great advantage in the medical product packaging industry if an effective seal could be provided which does not employ aluminum or other metals as sealing elements.

The lyophilization process itself is one which requires a great deal of precise control if efficiencies and economies are to be achieved. Particularly important is the rate of lyophilization, which must be controlled at a rate which does not damage or otherwise affect the drugs or other contents and yet which is as rapid as possible for economic reasons. It is always desirable to balance efficiency with effectiveness, so that the best possible product for the best possible price is produced. An improved design will be of great advantage in the packaging of medicament.

One of the difficulties incurred in packaging medicaments generally and in lyophilization processes in particular is the use of excess force to insert the stopper into the vial. One can visualize the effect of excessive stopper insertion force by picturing the shattering of a glass vial into countless particles. This is always to be avoided. The other end of this concern is that not enough force will be used to insert the stopper and thus the stopper will not properly seal the container.

Stoppering machines have been provided which control the amount of force used on the stopper, so that minimum and maximum amounts of force are controlled. The concern always exists, however, that a particular glass and rubber combination will be so far to the outer limits of manufacturing tolerances for each that failure will still occur. It would be of significant advance in the art if a stopper and container combination could be provided which would permit greater control of the force of insertion, particularly in lyophilization processes which employ a first force to seat the stopper in a lyophilization mode and a second force in the sealing mode.

One prior art device has been proposed which does eliminate the use of metallic seals, and this device is described in U.S. Pat. No. 4,516,684, to Walter. Although the design does eliminate aluminum or other metals, it is not particularly effective for medicaments which must be sealed with the effectiveness of a rubber stopper. As is clear from the Walter patent, a re-sealable closure is provided which is applied to the neck finish of a bottle and where there is a positive locking engagement between the closure and the neck. This is not a design for medical products, however, as the primary use suggested is for motor oil. There is no provision for a really effective seal of the type achieved with rubber stoppers, and, of course, there is no suggestion that a design could be provided which would be useful in a lyophilization process.

Another prior art design which purports to eliminate the need of aluminum or other metal seals is shown in Honma U.S. Pat. No. 4,279,353. Honma described a bottle cap which is wholly made of plastic, where an inner stopper member is made of a flexible plastic material and the outer cap is made of a plastic material which is more rigid than the inner member. The primary feature in Honma which is new is the use of a combination which can be shipped and stored in a combined form so as to be readily pressed into sealing engagement with the bottle neck in the stoppering step without being brought into that relationship inadvertently during that shipping or storage. Honma uses uniformly spaced first and second annular recesses, an integrally downwardly extending inner cylinder, and a pull ring. This design defeats the desirability of being able to seat the stopper portion directly by application of direct force on the entire assembly.

Still another prior art design which has been proposed for use as a closure assembly is Gettig et al U.S. Pat. No. 5,085,332. In this patent, a closure is provided which is one piece in design, where two break-away elements are formed with one of the two elements being displaceable to bias inherently resilient skirt segments about a receptacle rim. The device functions by means of an outwardly flared skirt portion which is biased inwardly by an overlying outer sleeve. The one piece design is intended for use with a stopper which includes a plug portion down into the neck of the vial, thereby preventing effective access to the contents before complete closure of the assembly, even before movement of the outer sleeve to the locking position. Gettig et al does not provide for access to the container when the stopper is inserted because of the plug. More importantly, particularly where glass is the only acceptable container and because glass finishes have a notorious degree of variation in tolerances, the Gettig et al device does not provide an effective seal in lyophilization closure assemblies.

It is an important need in the lyophilization process to eliminate a secondary stoppering step, but that has not been possible to date. Ideally, it would be a great advantage in the art if full stoppering could be done in the lyophilization chamber. The benefits of this advantage would be that the process could be practiced without the use of silicone, because the process would eliminate handling of the stopper after the lyophilization chamber.

Accordingly, it is an object of this invention to provide such a process.

It is also an object of the present invention to provide an effective seal for drug packaging which does not employ aluminum or other metals as sealing elements.

Yet another object of the present invention is to balance efficiency with effectiveness by providing an improved seal for lyophilization packaging.

Another object of the present invention is to provide a stopper and container combination which would permit greater control of the force of insertion, particularly in lyophilization processes which employ a first force to seat the liner or stopper in a lyophilization mode and a second force in the sealing mode.

Still another object of the present invention is to provide a design which permits the desirability of being able to seat the liner or stopper portion directly by application of direct force on the entire assembly.

One important object of the present invention is to provide a closure device which permits an effective seal for serum closure assemblies and particularly for lyophilization closure assemblies using standard glass.

Other objects will appear hereinafter.

SUMMARY OF THE INVENTION

It has now been discovered that the above and other objects of the present invention may be accomplished in the following manner. Specifically, the present invention comprises a closure device for use with a container having an open neck finish. The device includes an inner cap, a liner and an outer cap.

The inner cap of the device of this invention has a top end and a skirt dependent therefrom such that the skirt terminates in an open end which is specifically sized to engage the outside diameter of the open neck finish. The inner cap has an inwardly facing annular ring, which may be a solid ring or a plurality of raised beads, which is proximate the open end on the skirt to initially engage the finish to prevent initial passage of the skirt over the finish. The skirt includes a plurality of circumferentially spaced slits extending axially from the open end to permit the inner cap to expand upon a first axial closing force to move the bead to alignment with the bottom of the finish. These slits may function as lyophilization ports positioned to provide a lyophilization path into the open neck of the container and below the liner in the upper position.

An elastomeric liner is positioned in the inner cap at an upper position proximate the top end of the inner cap. The liner is supported in this upper position so as to be spaced from the neck of the container and permit access to the container in this pre-assembly condition, such as, for example, during a lyophilization process. When the bead is moved to alignment with the bottom of the finish, the liner is compressed in its position against the finish of the container. Preferably, the liner is an annular disc having a diameter greater than the inside diameter of the inner cap by an amount sufficient to supporting the liner in the upper position by friction between the skirt and the liner. The liner is compressed against the finish of the container by the inside face of the top end of the inner cap when the bead is in alignment with the bottom of the finish. It is understood that the term "liner" as used herein applies to the elastomeric liner shown in the drawings and that the term "liner" also applies to other shapes such as stoppers which have a dependant plug portion extending down into the neck of the vial or the like. Any conventional liner or stopper now used or used in the future is suitable for use in the present invention, and the term "liner" is intended to describe any and all of those articles.

In another embodiment, the liner is molded into the inner cap using a two-step injection molding step so that the liner becomes an integral part of the inner cap.

The outer cap has an inner diameter which is sized to engage the outside of the inner cap in a locked manner to position the outer cap in a pre-assembly position on the inner cap when the liner is in the upper position. The application of an axial force greater than the first axial closing force will disengage the inner and outer caps. In a preferred embodiment, the outer cap is locked to the outside of the inner cap by a ring and groove arrangement, with the ring being on the inside of the outer cap so that the ring engages the open end of the inner cap while the inner cap is in alignment with the bottom of the finish.

It is also preferred to have at least one inwardly facing annular ridge on the inside face of the closed end of the inner cap having a liner engaging edge spacing the liner from the inside face by a distance sufficient to permit the liner to seal to the finish over the maximum variation of dimensions for the liner and for the crown on the finish when the liner is compressed.

BRIEF DESCRIPTION OF THE DRAWINGS

For a more complete understanding of the invention, reference is hereby made to the drawings, in which:

FIG. 4 is plan view of the inner plastic radially notched cup of the two piece assembly of this invention.

FIG. 5 is a sectional elevational view taken along the line 5,5 of FIG. 4.

FIG. 6 is a sectional elevational view taken along the line 6,6 of FIG. 4.

FIG. 7 is a bottom plan view taken along the line 7,7 of FIG. 5.

FIG. 15 is identical to FIG. 10 except that a stopper with a dependent plug portion is shown.

DETAILED DESCRIPTION OF THE PREFERRED EMBODIMENT

As set forth above, the present invention has application in a wide variety of industries. The present invention is of particular interest in the pharmaceutical industry where medicaments are packaged in vials or glass bottles. Particularly where glass is the only acceptable container and where glass finishes have a notorious degree of variation in tolerances, the present invention is admirably suited to serum closure assemblies and particularly to lyophilization closure assemblies.

Figure 1:
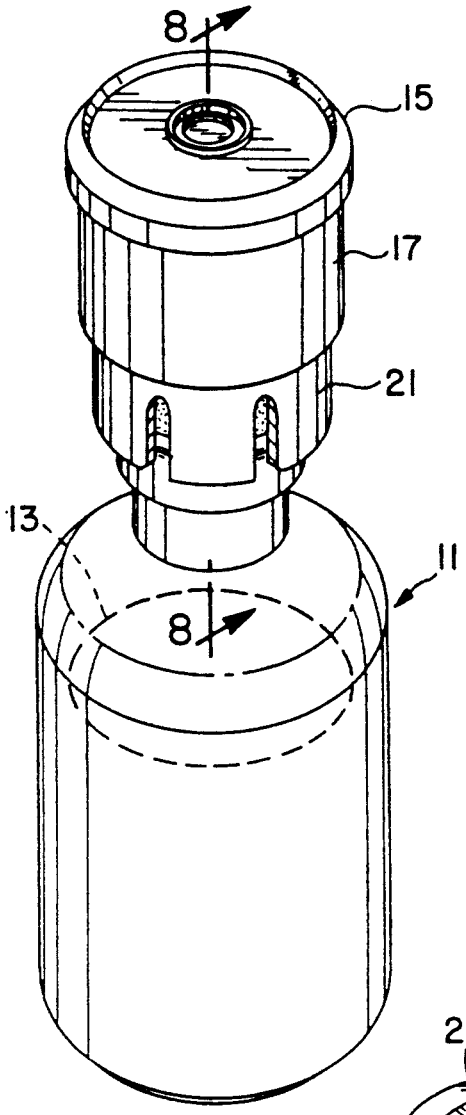
FIG. 1 is an enlarged isometric view showing a conventional glass vial containing a measured liquid medicament in combination with the closure device of this invention shown in a pre-sealing mode such as used in lyophilization applications.

The container 11 is shown in FIG. 1 having fluid 13 which, in this embodiment, is capable of lyophilization to a powder form for storage, transportation and later reconstitution by the addition of a reconstituting fluid such as distilled or deionized water. Container 11 also includes an overcap 15 such as the Flip-Off® brand overcap manufactured by The West Company under its trademark Flip-Off®. Overcap 15 is detachably attached to outer cap 17 to protect the contents and keep the surface of outer cap 17 protected until use. Removal of overcap 15 exposes outer cap 17 and permits access to liner disc 19 which, in turn, is held in place by inner cap 21 as described herein below.

Figure 2:
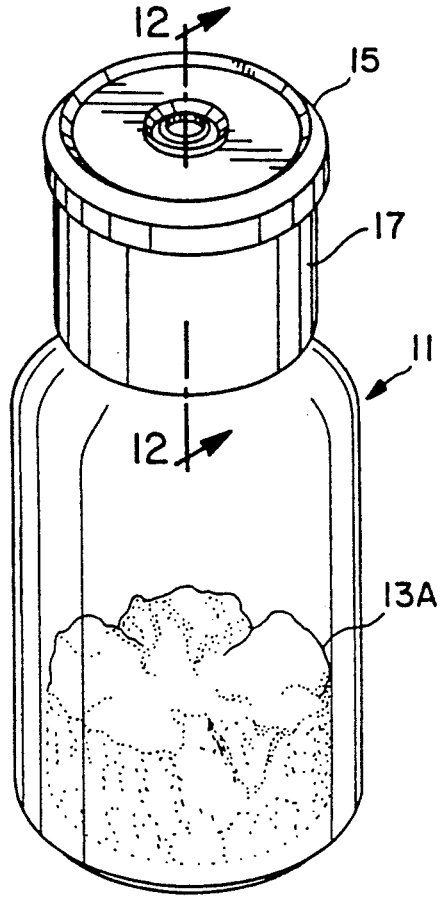
FIG. 2 is a view similar to FIG. 1 but showing the two piece assembly in a vial sealing mode.
Figure 3:
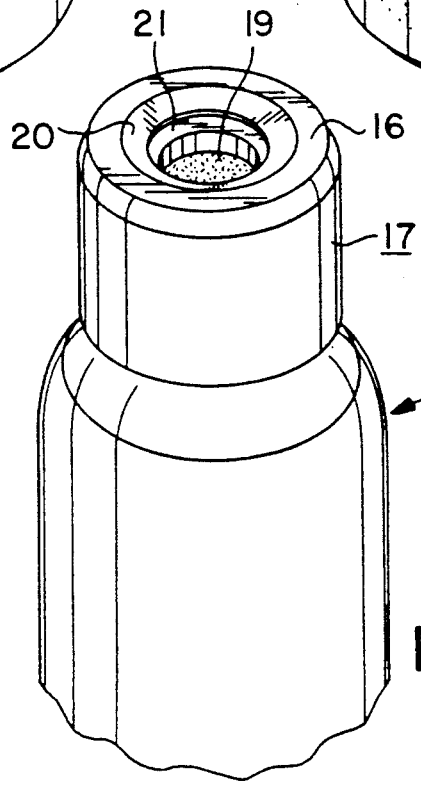
FIG. 3 is a fragmentary enlarged isometric view similar to FIGS. 1 and 2, but showing the device cover removed from the assembly, exposing the upper face of the sealing disc.

FIG. 1 shows the device assembled on the container 11 in a ready to use condition prior to lyophilization. After the lyophilization of the product 13A, the overcap 15, outer cap 17 and the entire assembly is pushed axially down to complete the assembly as shown in FIG. 2. Later removal of overcap 15, as illustrated in FIG. 3, permits use of a needle or cannula tipped syringe to add a reconstituting fluid and use the container as intended.

The inner cap 21 is uniquely designed with certain features which permit the accomplishment of the objects of this invention for the first time. Cap 21 has a top end 23 which includes a central bore 25 for access to the liner disc 19. Shown in FIG. 4 is the relationship between the central bore 25 and the top end 23. Depending from top end 23 is a skirt 27 which has an inwardly facing bead 29 at its lower terminal open end 31. End 31 is skewed inwardly by a small angle $\beta$ relative to the axis A-A shown in FIG. 5.

To this end the inner cap 21 has a series of circumferentially spaced radially inwardly directed ribs 29 which, as illustrated, extend between the circumferentially spaced axial slots 33. The ribs are spaced axially upwardly from the lower peripheral edge of the inner cap 21. End 31 functions as a friction pad and is located below each of the ribs 29 having an inner face tapering inwardly and downwardly at angle $\beta$ relative to the axis A-A of the inner cap 21. A circular trace through the lower portion of each pad is preferably of a diameter D (shown in FIG. 4) in the relaxed state, slightly less than the diameter $D_1$ (shown in FIG. 8) of the container finish. The diameters are preferably sized so that when the inner cap is applied to the container finish in the manner shown in FIG. 8, the wall segments 27*a* flex radially outwardly. Substantially the entire face of the pad on end 31 is aligned with the side wall of the container finish to provide a large surface to surface contact area firmly seating the cap assembly and resisting dieplacement during the lyophilization process.

The top portion 16 of the outer cap 17 has a central opening 18 to receive the locking flange 15*a* of the overseal 15. The top portion has an inwardly tapered frustoconical section 20 diverging toward the central opening in the outer cap to provide better access to the exposed portion of the seal 19 to insure the entire exposed area of the stopper is properly sterilized.

As will be appreciated, angle $\beta$ is designed to permit end 31 to be forced radially outward from the center by just that slight distance necessary to permit end 31 to be parallel to the side of the container as described below. Skirt 27 also includes a plurality of circumferentially spaced and axially extending slits 33, which are shown as lyophilization ports in FIGS. 4–7, and which permit end 31 to be forced radially outwardly as just described. Also depending from top end 23 are pointed inwardly facing annular rings 35 which will engage the liner disc 19 as described below.

In a preferred embodiment, the liner 19 is molded into the inner cap 21 using a two step injection molding process, so that liner 19 becomes an integral part of cap 21.

Figure 8:
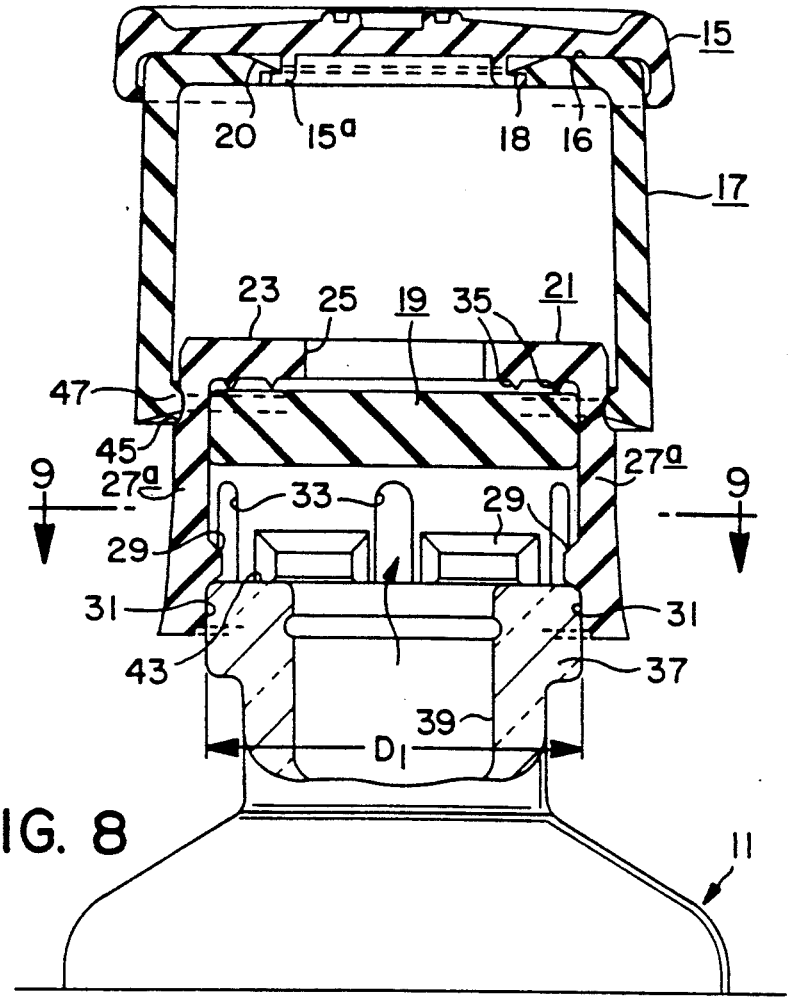
FIG. 8 is an enlarged fragmentary sectional elevational view taken along the line 8,8 of FIG. 1.
Figure 9:
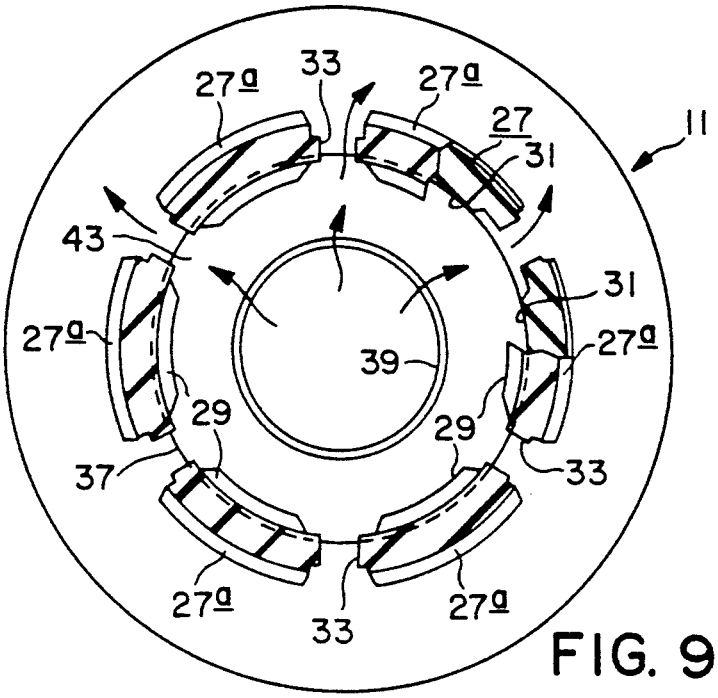
FIG. 9 is a sectional plan view taken along the line 9,9 of FIG. 8.

Shown in FIG. 8 is the closure device of this invention in a lyophilization mode, with ports or slits 33 open to expose the contents along the path shown by the arrows in FIGS. 8 and 9. The inner cap 21 is mounted on the finish 37 of container 11 to provide a flow path through slits 33 into the open neck 39 of finish 37 as shown by the arrows. Inner cap 21 is firmly held in positioned on container finish 37 by the flat surface of end 31, because of the slight angle $\beta$ illustrated in FIG. 5. Cap 21 will not be easily displaced and will remain in the position illustrated until the beaded ring 29 engages finish bottom 41, shown later.

In this view, the open end 31 of skirt 27 is positioned by the beaded ring 29 which rests on the top or open neck 43. Outer cap 17 is locked on to inner cap 21 by a groove 45 on cap 21 and an inwardly facing ring 47 on the inside of cap 17 at its open end. The outer cap 17 is locked in this preliminary position until the device is closed. As this assembly is placed along side many similar assemblies in a lyophilization process, minor contact with the walls or with other container assemblies will not cause the cap to be dislodged.

Of major importance in the assembly shown in FIG. 8 is the location of the liner disc 19 with respect to the top end 23 of cap 21. Disc 19 is positioned proximate the top end, thereby providing access to the open neck 39, which would not be possible if the liner included a dependent plug portion extending into the open neck 39, nor would it be possible if disc 19 were allowed to lie flat on the upper face 43 of finish 37. Stopper disc 19 also confronts the inner face of top end 23 of cap 21 to engage a pointed or sharp inwardly facing annular rings 35.

Rings 35 serve to space the disc 19 from the inner face of top end 23 so that later compression accommodates the wide variation in tolerances from various container finishes. Glass containers are manufactured in large quantities and the inherent amorphous nature of glass sometimes prevents close tolerances during manufacture. This becomes important in the present invention when the closure assembly is sealed, since integrity of seal is a major consideration in pharmaceutical packaging.

Figure 10:
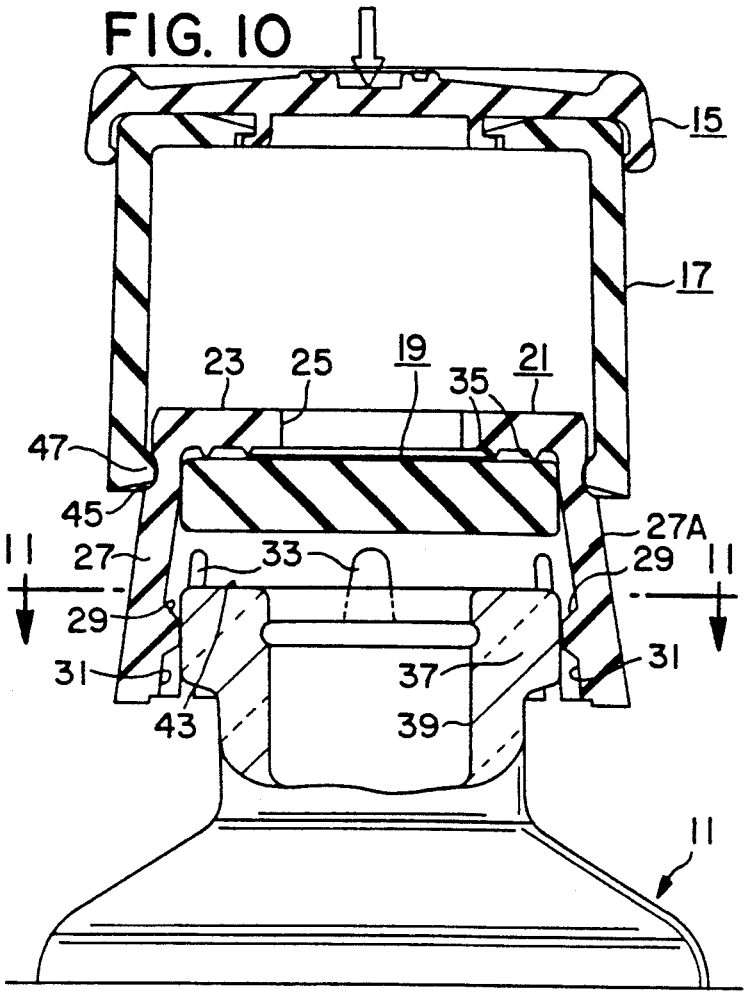
FIG. 10 is a view similar to FIG. 8 but showing an intermediate position of the device as it is being pressed downwardly on the rim of the vial.
Figure 11:
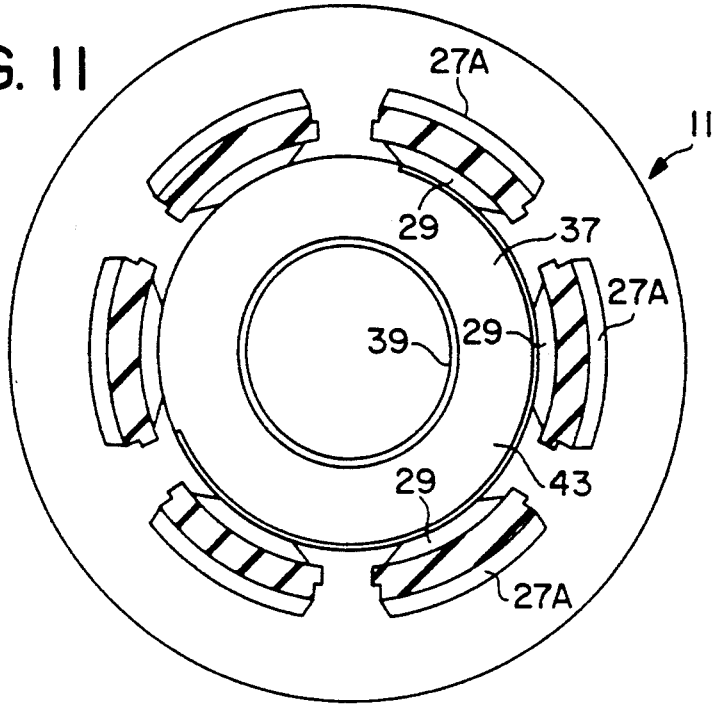
FIG. 11 is a sectional view taken along the line 11,11 of FIG. 10.

FIG. 10 is similar to FIG. 8, illustrating in this view the intermediate state or position of the inner cap 21 as it is subjected to a closing force in the axial direction. Skirt 27A has been forced outward as beads 29 pass over finish 37 as illustrated. At this same time, bending of skirt 27A causes compression of disc 19 which has been held frictionally in its upper position away from the neck opening 39, thus keeping liner disc 19 away from the finish until a complete seal is desired.

Figure 12:
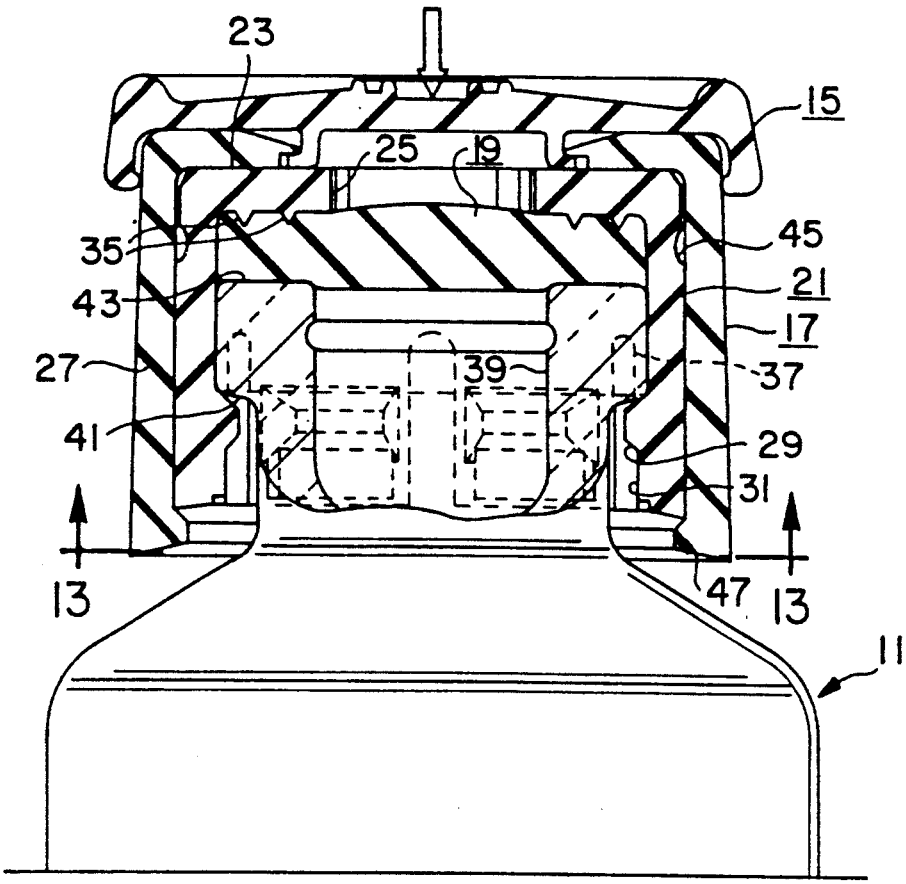
FIG. 12 is an enlarged, fragmentary, sectional, elevational view taken on the line 12,12 of FIG. 2, showing the two piece assembly in a vial sealing mode.
Figure 13:
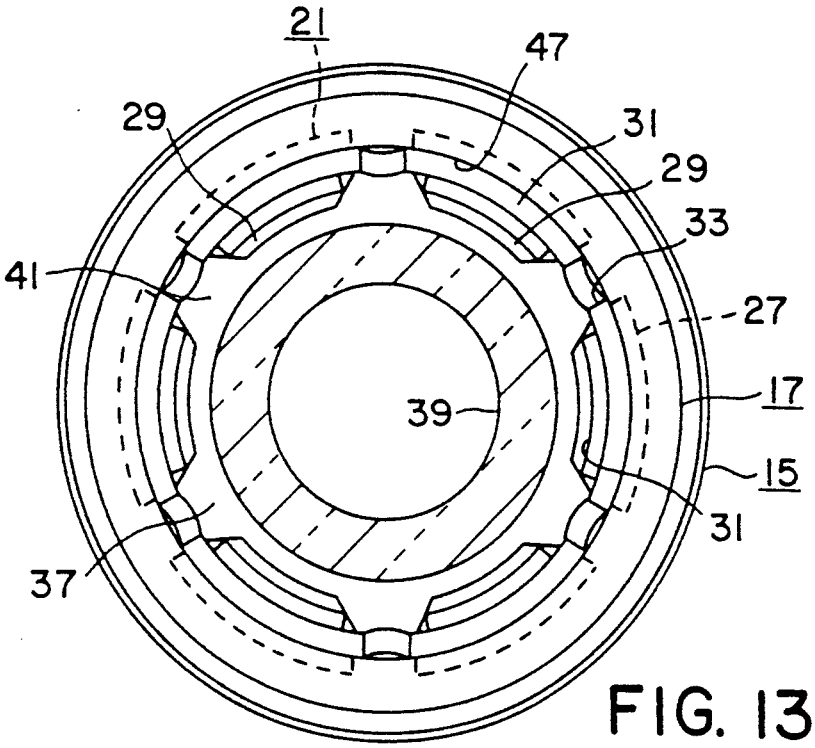
FIG. 13 is a sectional view taken along the line 13,13 of FIG. 12.

While the force used to move inner cap 21 to the position shown in FIG. 10 is sufficient to overcome the resistance of beads 29 on finish 37, the force less than that which would be sufficient to dislodge groove 45 and ring 47 from one another, so that outer cap 17 remains positioned as shown in FIG. 10. In FIG. 12, the liner disc is compressed between the finish top 43 and the inner face of top end 23 of inner cap 21. This compression of liner disc 19 is adequate to seal the closure even after lyophilization, so that industry standards for seal integrity are more than met by this design. Without adequate compression of disc 19, the most extreme forms of this standard would not be met in every case.

In another embodiment, the liner is molded into the inner cap using a two-step injection molding step so that the liner becomes an integral part of the inner cap.

Ultimately, the device is totally sealed for shipping and even more protection against leakage as depicted in FIG. 12. Ring 47 extends inwardly from outer cap 17 over the open end 31 of inner cap 21. By careful design of dimensions, ring 47 can further locate liner disc 19 on the finish top 43 and further lock the bead ring 29 of inner cap 21 onto the bottom 41 of finish 37.

Figure 14B:
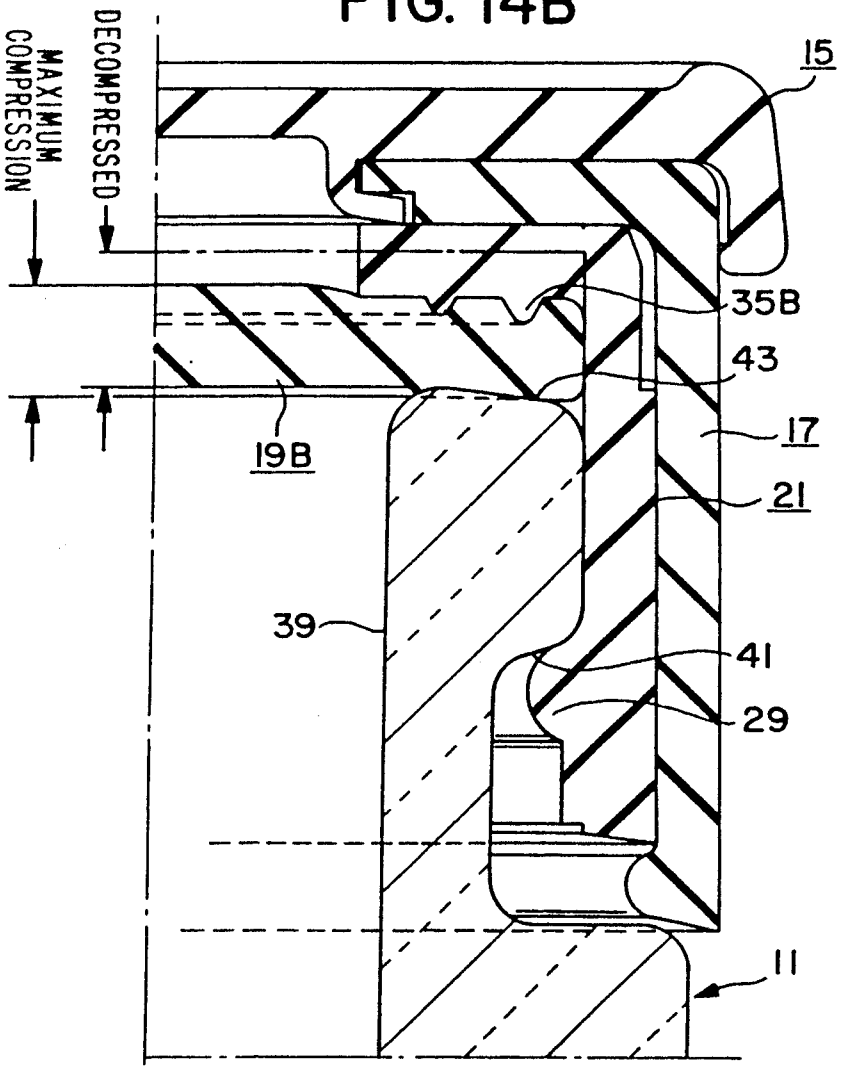
FIGS. 14A and 14B are greatly enlarged, sectional views showing aspects of the invention where maximum and minimum tolerances are employed.
Figure 14A:
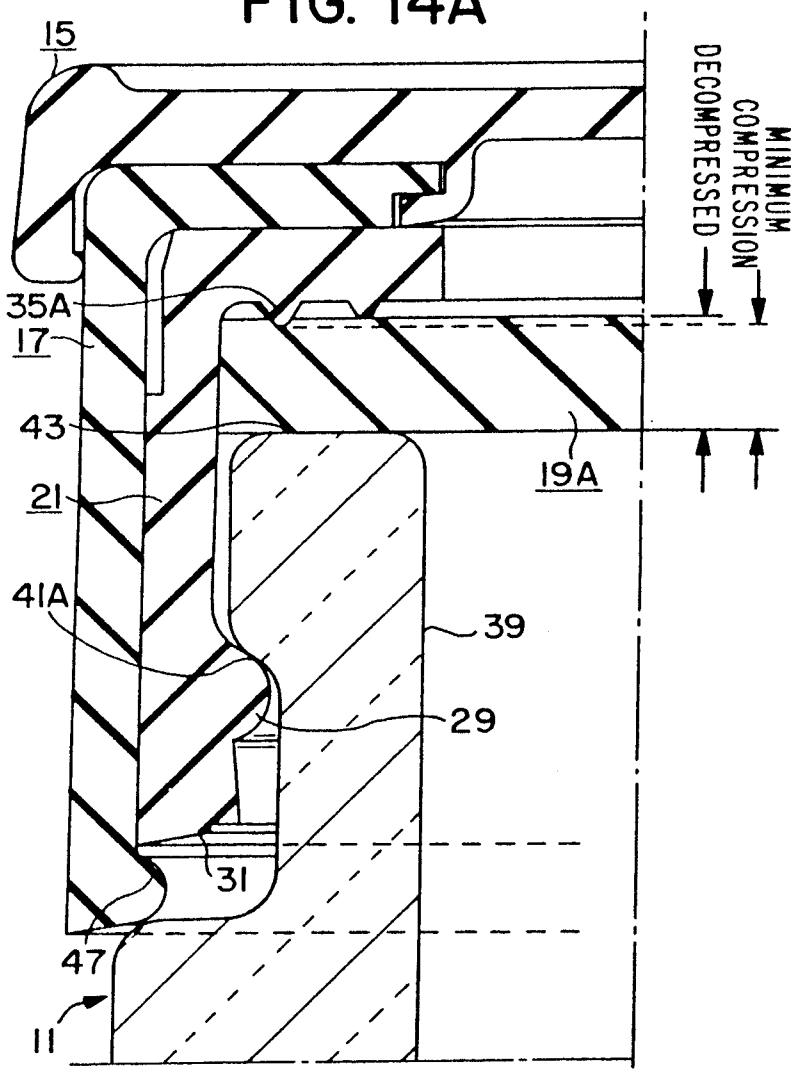

FIGS. 14A and 14B illustrate an important feature of the present invention, by showing the ability of the invention to function over wide ranges of variations in tolerances. When liner disc 19A is compressed against the glass vial 11 between the closed end of inner cap 21 to thus be in compression contact with downwardly facing annular ring (35A or 35B), there is sufficient spacing of the liner (19A or 19B) to permit the liner disc to seal to finish top 43 over the maximum variation of dimensions for the liner and for the crown on said finish when said liner is compressed.

FIG. 14A illustrates the extreme condition where minimum acceptable tolerances have been selected. Ring 35A still seals liner 19A, and finish bottom 41A still engages bead ring 29. In FIG. 14B, where the other extreme condition of maximum acceptable tolerances have been illustrated, ring 35B has room to compress liner 19B and finish bottom 41 is also able to engage bead ring 29. Thus, for the first time, a closure is able to accommodate a wide range of finishes on glass containers while still affording a seal which meets the standards needed for commercial acceptance.

This invention provides for a closure device which can be used over a wide range of bottle finishes without concern for even the significant variations in tolerances sometimes found in glass container manufacture. For the first time, all of the objects of the present invention may be accomplished in one device. Aluminum and other metal seals are eliminated, and access to the contents for purposes such as lyophilization are maintained. Good seal integrity is achieved over a wide range of container finishes.

While particular embodiments of the present invention have been illustrated and described, it is not intended to limit the invention, except as defined by the following claims.

We claim:

1. A closure for use with a container having a discharge opening, comprising:

an inner cap having a top and a skirt depending axially therefrom, said skirt terminating in first engagement means for engaging said container adjacent said discharge opening to provide a first assembly position with said top spaced from said container by a first distance, said skirt including a plurality of circumferentially spaced slits;

a liner held by said skirt in a position proximate to said top and having a thickness less than said first distance to cooperate with said slits to define an air path for access to said discharge opening in said first assembly position;

an outer cap having a top and a dependant skirt including second engagement means on its terminal end for engaging the outside of said inner cap proximate its top in said first assembly position;

said first engagement means disengages upon application of a first axial force to move said inner cap and said liner to sealing engagement with said discharge opening; and said second engagement means disengages upon application of a second greater force to thereby position said outer cap in surrounding relationship over said inner cap.

2. The device of claim 1, wherein said second engagement means comprises an outwardly facing groove on said outside of said inner cap and an inwardly facing ring on said inner diameter of said outer cap.

3. The device of claim 1, wherein said liner is an disc having a diameter greater than the inside diameter of said inner cap by an amount sufficient to supporting said liner in said upper position by friction between said skirt and said liner.

4. The device of claim 1, wherein said liner is compressed against said container by the inside face of said top of said inner cap.

5. The device of claim 4, which further includes at least one inwardly facing annular ridge mounted on the inside face of said top of said inner cap and having a liner engaging edge spacing said liner from said inside face by a distance sufficient to permit said liner to seal to said container over the maximum variation of dimensions for said liner and for the crown on said container when said liner is compressed.

6. The device of claim 1, wherein said liner is a flat elastomeric disc.

7. The device of claim 1, wherein said liner is a stopper having a dependant plug portion.

8. The device of claim 1, wherein said liner is molded into the inner cap using a two step injection molding step to become an integral part of said inner cap.

9. The device of claim 1, wherein said inner cap includes a terminal end having an inwardly facing surface for contacting said container, said surface being skewed inwardly to force said surface outward to grip said container as it is forced into parallel contact with said container.

* * * * *